United States Patent [19]

Troubridge

[11] Patent Number: 4,867,272

[45] Date of Patent: Sep. 19, 1989

[54] STEPS FOR CLIMBING TREES

[76] Inventor: William C. Troubridge, R.R. 1, Breslau, Ontario, Canada, N0B 1M0

[21] Appl. No.: 246,680

[22] Filed: Sep. 20, 1988

[51] Int. Cl.[4] ..... A63B 27/00; A63B 29/04

[52] U.S. Cl. ..... 182/92; 182/189

[58] Field of Search ..... 182/92, 228, 189

[56] References Cited

U.S. PATENT DOCUMENTS

| | | | |
|---|---|---|---|
| 2,097,562 | 11/1937 | Day | 182/92 |
| 3,498,409 | 3/1970 | Meyer | 182/92 |
| 4,000,788 | 1/1977 | Burgess | 182/92 |
| 4,415,061 | 11/1983 | Meyers | 182/92 |
| 4,669,575 | 6/1987 | Skyba | 182/92 |
| 4,700,807 | 10/1987 | Kubiak | 182/92 |

*Primary Examiner*—Reinaldo P. Machado

*Attorney, Agent, or Firm*—R. Craig Armstrong

[57] ABSTRACT

A tree step is disclosed, including a substantially L-shaped step member of constant cross section. The upright portion of the L-shape is provided with an aperture adapted to hang over a lag screw. The aperture is elongated, with its lower aspect being wide enough to allow it to be passed over the head of the lag screw, and its uppper aspect being somewhat narrower and unable to pass over the head of the lag screw. In the preferred embodiment, at least one and preferably two anchoring lugs project inwardly from a lower portion of the upright portion of the L-shape, each lug having a contoured lower surface and a somewhat pointed upper surface. The upright portion of the L-shape extends somewhat below the horizontal portion, with an integral strut provided between the horizontal portion and the downward extension of the upright portion. The lower portion of the aperture is shaped to match the head of the lag screw.

8 Claims, 2 Drawing Sheets

STEPS FOR CLIMBING TREES

BACKGROUND OF THE INVENTION

This invention relates to steps which are attachable to a tree to facilitate climbing of the tree.

In many situations, such as the one in relation to which the present invention was conceived, namely hunting, especially bow hunting, it is desireable to have means to facilitate climbing a tree. Various devices have been known in the prior art, and generally consist of some small step arrangement which is screwed into or otherwise attached to the tree.

Desireable features of a tree step are that it be inexpensive, reliable, light in weight, and simple to transport. Additionally, it should preferably be readily removable from the tree, either temporarily or permanently.

SUMMARY OF THE INVENTION

It is an object of the present invention to provide a tree step which is simple in construction, light in weight, reliable, and simple and inexpensive to manufacture.

Thus in accordance with the invention there is provided a tree step, including a substantially L-shaped step member of constant cross section. The upright portion of the L-shape is provided with an aperture adapted to hang over a lag screw. The aperture is elongated, with its lower aspect being wide enough to allow it to be passed over the head of the lag screw, and its upper aspect being somewhat narrower and unable to pass over the head of the lag screw.

In the preferred embodiment, at least one and preferably two anchoring lugs project inwardly from a lower portion of the upright portion of the L-shape, each lug having a contoured lower surface and a somewhat pointed upper surface. The upright portion of the L-shape extends somewhat below the horizontal portion, with an integral strut provided between the horizontal portion and the downward extension of the upright portion. The lower portion of the aperture is shaped to match the head of the lag screw.

BRIEF DESCRIPTION OF THE DRAWINGS

The preferred embodiment of the invention will now be described by way of example only, with reference to the accompanying drawings, in which.

DETAILED DESCRIPTION OF THE PREFERRED EMBODIMENT

Figure 1:
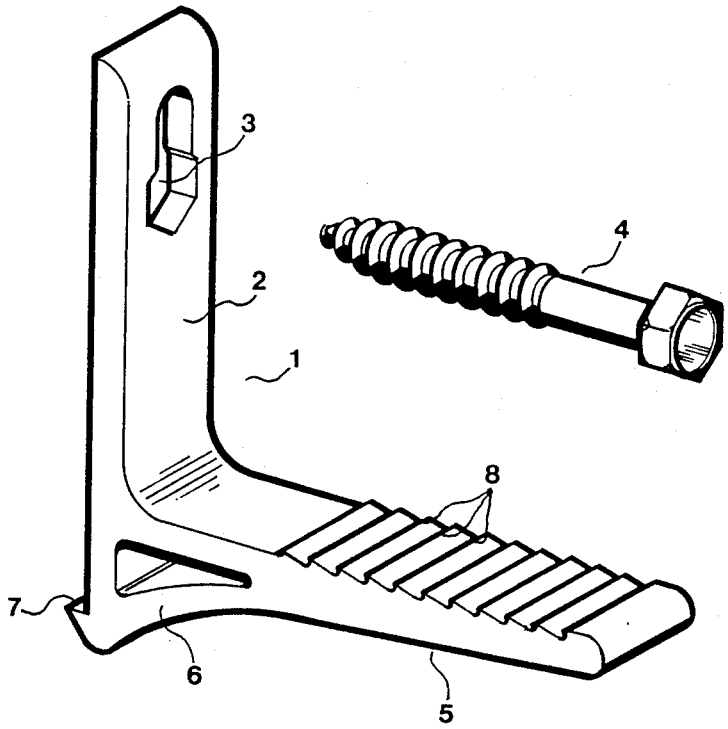
FIG. 1 is a perspective of the tree step.
Figure 2:
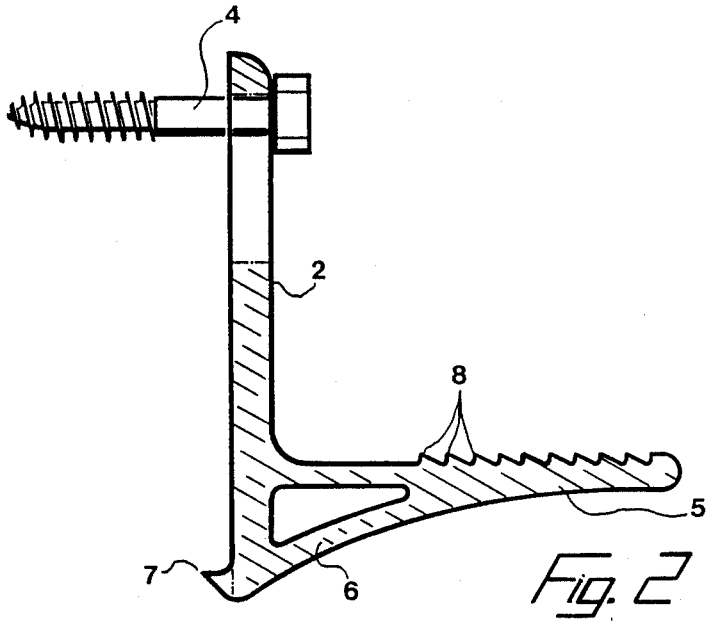
FIG. 2 is a side view.
Figure 3:
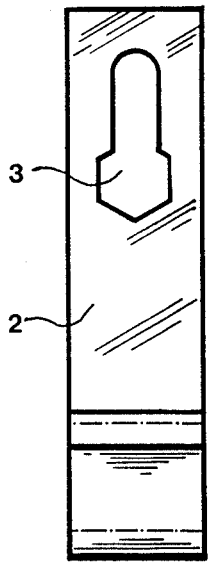
FIG. 3 is a front view.
Figure 4:
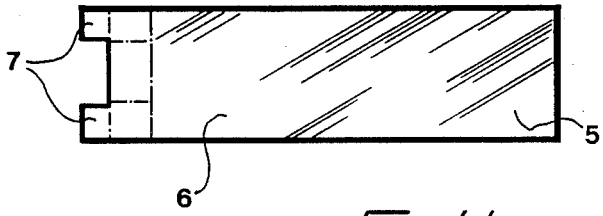
FIG. 4 is a bottom view.

The preferred embodiment of the invention includes a substantially L-shaped step member 1 of constant cross section, the upright portion 2 of the L-shape being provided with an aperture 3 for hanging over a lag screw 4 which is threaded into the tree (not shown). The aperture is elongated, with its lower aspect being wide enough to allow it to be passed over the head of the lag screw, and its upper aspect being somewhat narrower, so that it cannot pass over the head of the lag screw.

The horizontal portion 5 of the L-shape constitutes a step portion projecting outwardly from the upright portion. The upright portion extends somewhat below the horizontal portion, with support means provided between the horizontal portion and the downward extension of the upright portion, for greater strength, in the form of an integral strut 6. Near the bottom of the downward projection, on the inside face, are two anchoring lugs 7 laterally disposed from each other, each lug having a contoured lower surface and a somewhat pointed upper surface. With this shape, the anchoring lugs are free to move downwardly on the tree under the weight of the person, the underside being contoured or curved, and the pointed upper end anchors in the tree. The anchors not only prevent the step from being lifted away from the tree should the person's footwear be adhering to the step portion by virtue of mud on the footwear or for some other reason, but also serve the purpose of anchoring the step laterally to provide greater stability, rather than having a step which is capable of swinging from side to side.

The step portion 5, i.e. the horizontal portion of the L-shape, is preferably provided with a series of corrugations or angled notches 8, in order to provide greater traction for the person's footwear.

It is a particular advantage of the invention that its very simple construction permits it to be made in a minimum number of operations, therefore at very low cost. Because the step has a constant cross-section, it lends itself to being manufactured by forming an extrusion having this cross-section. The extrusion is preferably of aluminum so that the weight of the step is minimized. When the extrusion is formed, it is a simple matter to cut off portions which are one to two inches in width or whatever step width is desired, and then simply stamp the aperture 3 in the upright portion of the L-shape (or preferably stamp the aperture before the individual steps are cut from the extrusion).

Many steps in the prior art are not readily detachable from the tree. In the case of the present invention, a number of lag screws can be threaded into the tree or trees at desired locations. Once the screws are in place, it will be appreciated that it is a very simple matter with the present invention to put the steps in place and then to remove them when desired. If permanent removal is desired, then of course the lag screws can be removed also. With this two-piece arrangement it is not necessary for the person to have a full step-and-screw set for every location where a step may be desired. All that is required is a number of lag screws, and then the person needs only have the number of steps which would be used at any given time or location. This feature is particularly advantageous for preventing theft of tree stands or the like to which the tree steps may lead, or for preventing theft of the steps themselves.

Preferably, the lower portion of the aperture is shaped exactly to the hexagonal head of the typical lag screw, so that any possibility of the step being dislodged from the lag screw is minimized, since not only would the lower portion of the aperture have to be positioned opposite the head of the screw, it would also have to be perfectly aligned with the head of the screw. The head of the screw can be deliberately positioned so that there is misalignment when the step is in its properly installed position. (The aperture should not be used as a wrench to screw or unscrew the lag screw into the tree, since this may overstress the step and lead to complete failure, or to a condition where there is a crack which is not detected.)

To install the tree step, the lag screw 4 is screwed into the tree at the desired location, and the aperture 3 is positioned over the head of the lag screw. The step portion is then pulled down so that the lag screw is located in the narrow upper portion of the aperture. Foot pressure on the step drives the anchoring lugs 7 into the tree for added stability and safety. Removal requires only the reverse process, and is thus very quick and easy.

The above description relates to the preferred embodiment by way of example only. Many obvious variations on the invention would be apparent, and such obvious variations are considered to be within the scope of the invention, whether or not expressly described and claimed herein.

What is claimed as the invention is:

1. A tree step, comprising a substantially L-shaped step member of constant cross section, the upright portion of said L-shape being provided with an aperture adapted to hang over a lag screw, said aperture being elongated, with its lower aspect being wide enough to allow it to be passed over the head of said lag screw, and its upper aspect being somewhat narrower and unable to pass over the head of the lag screw.

2. A tree step as recited in claim 1, in which at least two anchoring lugs projects inwardly from a lower portion of the upright portion of the L-shape, each lug having a contoured lower surface and a somewhat pointed upper surface.

3. A tree step as recited in claim 1, in which the upright portion of said L-shape extends somewhat below the horizontal portion, with an integral strut provided between the horizontal portion and the downward extension of the upright portion.

4. A tree step as recited in claim 2, in which the upright portion of said L-shape extends somewhat below the horizontal portion, with an integral strut provided between the horizontal portion and the downward extension of the upright portion.

5. A tree step as recited in claim 1, in which the lower portion of the aperture is shaped to match the head of the lag screw.

6. A tree step as recited in claim 2, in which the lower portion of the aperture is shaped to match the head of the lag screw.

7. A tree step as recited in claim 3, in which the lower portion of the aperture is shaped to match the head of the lag screw.

8. A tree step as recited in claim 4, in which the lower portion of the aperture is shaped to match the head of the lag screw.

* * * * *